US006202450B1

(12) United States Patent
Chen

(10) Patent No.: US 6,202,450 B1
(45) Date of Patent: Mar. 20, 2001

(54) UNIFORM YARN DELIVERY METHOD AND APPARATUS FOR KNITTING MACHINE

(76) Inventor: Jen Fu Chen, 7 Fl., No. 161, Hsin Yi Road, Pan-Chiao City, Taipei County (TW)

( * ) Notice: Subject to any disclaimer, the term of this patent is extended or adjusted under 35 U.S.C. 154(b) by 0 days.

(21) Appl. No.: 09/577,245

(22) Filed: May 24, 2000

(51) Int. Cl.[7] ..... D04B 15/48
(52) U.S. Cl. ..... 66/132 R; 66/125 R; 66/146
(58) Field of Search ..... 66/125 R, 131, 66/132 R, 132 T, 146, 125 A; 226/195, 44, 45; 242/364, 365.6, 365.7, 147 R, 153, 155 R, 615; 139/452

(56) References Cited

U.S. PATENT DOCUMENTS 6,105,398 * 8/2000 Leins et al. ..... 66/132 R

FOREIGN PATENT DOCUMENTS

2661924 * 11/1991 (FR) ..... 66/132
1326672 * 7/1937 (SU) ..... 66/132

* cited by examiner

*Primary Examiner*—Danny Worrell
(74) *Attorney, Agent, or Firm*—Ware, Fressola, Van Der Sluys & Adolphson LLP

(57) ABSTRACT

A uniform yarn delivery method and apparatus for a knitting machine is disclosed. The method comprises the steps of sending yarn derived from a supply cone to be guided on a yarn supply drum so as to tighten yarn thereon; and suitably uniformly slackening the taut yarn sent from yarn supply drum prior to sending to said knitting machine for knitting under the same vibration of a yarn tension detection arm. With this, all yarn sections are the same in length, loops are identical, and fabric has a uniform texture.

12 Claims, 4 Drawing Sheets

UNIFORM YARN DELIVERY METHOD AND APPARATUS FOR KNITTING MACHINE

BACKGROUND OF THE INVENTION

1. Field of the Invention

The present invention relates to a yarn delivery method, and more particularly to a uniform yarn delivery method and apparatus for a circular knitting machine.

2. Description of Related Art

Fabric consists of many loops (i.e., warp and weft). A uniform loop is key to a high quality fabric. Further, the uniform loop is determined by a good knitting process. As such, a stable and uniform yarn delivery is an object to be achieved by fabric manufacturers.

Conventionally, yarn supply device is for providing a stable and uniform yarn delivery. In comparing a simple yarn supply drum with a storing drum, the latter has a better yarn delivery capability. However, the storing drum may suffer at least one of the problems such as yarn winded on drum not uniformly delivered toward the lower position, loops entangled, and dislocation of loops. Further, the yarn tension detection arm of the storing drum presses on yarn by its weight only. The yarn tension detection arm is stopped immediately after yarn tension disappears. However, this technique is outdated because 1) it cannot accommodate high speed knitting requirements today, and 2) the yarn tension detection arm is not sufficiently sensitive. As such, fabric knitted by a knitting machine equipped with such a storing drum is poor in quality. Thus it is not acceptable by the fabric manufacturing art.

In a typical yarn delivery technique, tension of yarn is related to cam position of the knitting machine. Conventionally, yarn is made as taut as possible before entering the knitting machine so as to enhance yarn tension, thereby obtaining loops with uniform tension and identical size. However, it is impossible to visually determine the uniformity of yarn tension because, as stated above, the yarn tension detection arm is activated by its weight (i.e., non-adjustable) and yarn is too taut. In fact, the cam position usually is adjusted by an experienced operator. The operator often adjusts the yarn tension to its maximum. As a result, fabric quality is poor as manufactured by high speed knitting machines. Further, a variety of disadvantages such as short pitch, small loop, breakage, dislocation, rough, poor quality, low elasticity, and high contraction are experienced.

SUMMARY OF THE INVENTION

It is thus an object of the present invention to provide a uniform yarn delivery method and apparatus for a knitting machine for eliminating the above drawbacks of prior art.

It is another object of the present invention to provide a uniform yarn delivery method and apparatus for a knitting machine for obtaining a uniform, smooth, glossy, and high quality fabric.

It is still another object of the present invention to provide a uniform yarn delivery method and apparatus for a knitting machine wherein the loop length per delivery is maximum, loops are uniform and identical, and fabric has the advantages of smoothness, high elasticity, and low contraction.

It is a further object of the present invention to provide a uniform yarn delivery method and apparatus for a knitting machine wherein the knitting machine is of high efficiency and highly utilized. Further, yield is sufficiently high and the knitting machine has a low wear-out, thereby reducing the manufacturing cost.

To achieve the above and other objects, the present invention provides a uniform yarn delivery method comprising the steps of: (1) sending yarn derived from a supply cone to be guided tangentially on a yarn supply drum so as to tighten yarn thereon; (2) suitably slackening the taut yarn sent from yarn supply drum prior to sending to a yarn tension detection arm; (3) the yarn tension detection arm elastically vibrating the yarn; and (4) adjusting the cam position associated with the yarn tension detection arm so as to cause yarn to enter into the knitting machine for knitting under the same vibration of the yarn tension detection arm. With this, all yarn sections are the same in length, loops are identical, and fabric has a uniform texture.

To achieve the above and other objects, the present invention provides a uniform yarn delivery apparatus comprising a yarn supply drum, a yarn tension detection arm, a lead-in yarn eye, an outgoing yarn stop-motion device, and a hook wherein at least one winding of yarn is stored on the circumference of a yarn supply drum, a yarn brake of the outgoing yarn stop-motion device has a spring for adjusting the vibration of yarn so as to function in cooperation with the position of cam to adjust yarn, thereby preliminarily tightening yarn prior to sending to the yarn supply drum, and the yarn tension detection arm elastically vibrates the yarn. With this, yarn sections are the same in length, loops are identical, and fabric has a uniform texture.

The above and other objects, features and advantages of the present invention will become apparent from the following detailed description taken in conjunction with the accompanying drawings.

DETAILED DESCRIPTION OF THE PREFERRED EMBODIMENTS

Figure 1:
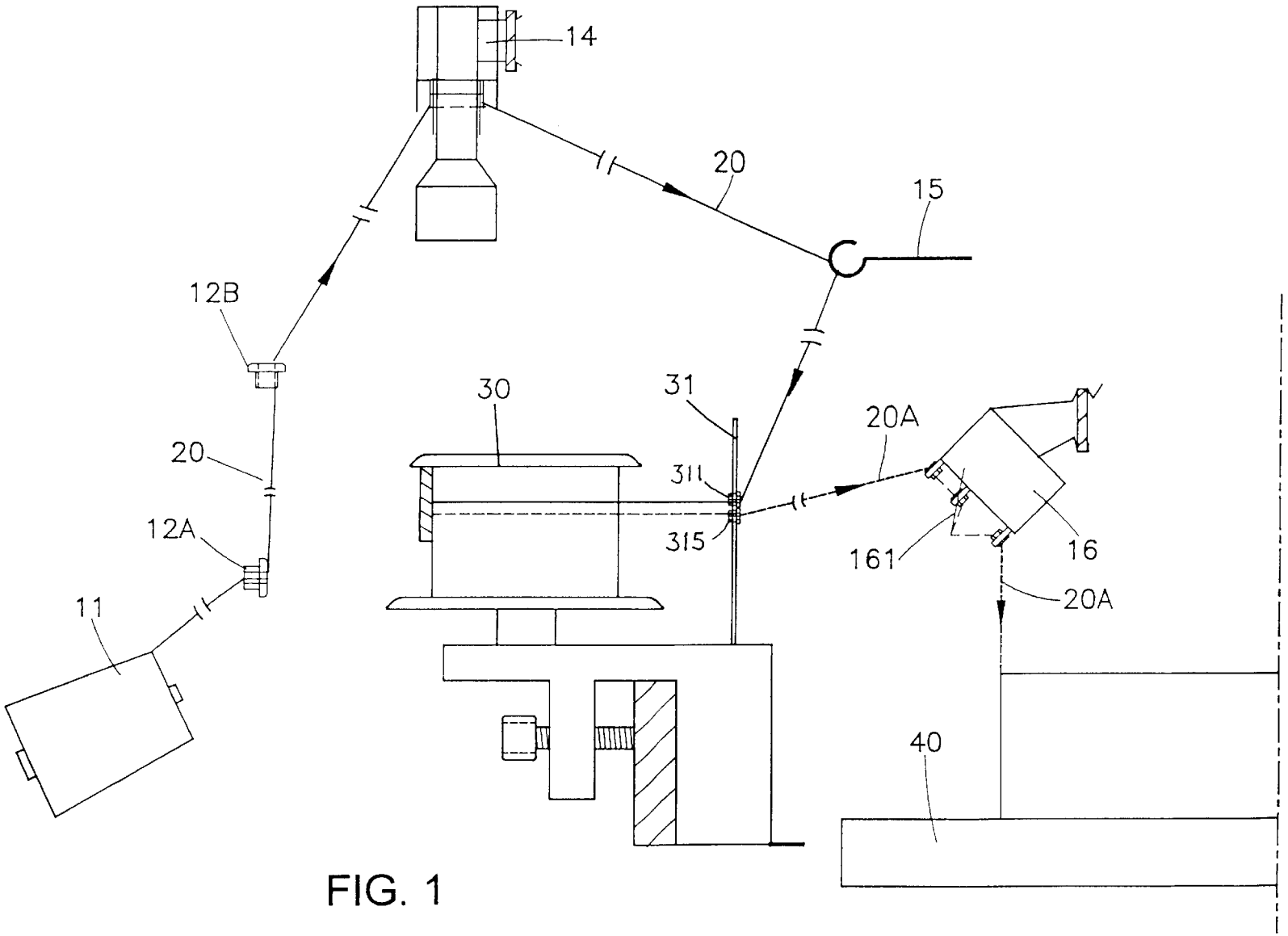
FIG. 1 is a side view of a first preferred embodiment of yarn delivery apparatus according to the invention.

In a first mode of the yarn delivery method according to the invention, the method comprises the steps of: sending yarn derived from a supply cone to be guided tangentially on a yarn supply drum so as to tighten yarn thereon; suitably slackening the taut yarn sent from the yarn supply drum prior to sending to a yarn tension detection arm; the yarn tension detection arm elastically vibrating the yarn; and adjusting the cam associated with the yarn tension detection arm so as to cause yarn to enter into a knitting machine for knitting under the same vibration of a yarn tension detection arm. With this, yarn sections are the same in length, loops are identical, and fabric has a uniform texture.

In a second mode of the yarn delivery method according to the invention, the method comprises the steps of: tightening yarn derived from a supply cone prior to sending to a yarn supply drum for being guided tangentially thereon; suitably slackening the taut yarn sent from the yarn supply drum prior to sending to a yarn tension detection arm; the yarn tension detection arm elastically vibrating the yarn; and adjusting the cam position associated with the yarn tension detection arm so as to cause yarn to enter into a knitting machine for knitting under the same vibration of the yarn tension detection arm. With this, yarn sections are the same in length, loops are identical, and fabric has a uniform texture.

In a first preferred embodiment of yarn delivery apparatus according to the invention, the apparatus comprises a yarn supply drum, an outgoing yarn tension detection arm, a lead-in yarn eye, a stop-motion device, and a hook wherein at least one winding of yarn is stored on the circumference of a yarn supply drum, a yarn brake of the stop-motion device has a spring for adjusting the vibration of yarn so as to function in cooperation with cam position to adjust yarn, thereby preliminarily tightening yarn prior to sending to a yarn supply drum, and a yarn tension detection arm elastically vibrates the yarn. With this, yarn sections are the same in length, loops are identical, and fabric has a uniform texture.

In a second preferred embodiment of yarn delivery apparatus according to the invention, the apparatus comprises a storing drum, a yarn tension detection arm, outgoing and incoming yarn stop-motion devices, a yarn brake means, and a plurality of yarn guiding means for guiding yarn derived from a supply cone to a yarn tension detection arm wherein a yarn tension detection arm of the yarn stop-motion device in the outgoing yarn path of the storing drum has a spring for adjusting the vibration of yarn such that the outgoing yarn stop-motion device can further function in cooperation with the position of cam to adjust yarn, thereby preliminarily tightening yarn prior to sending to a storing drum, then, after leaving the storing drum with suitably slackened yarn to cause it to have an optimum tension, adjusts cam position so as to cause all yarn to have the same tension before entering the knitting machine for knitting. With this, yarn sections are the same in length, loops are identical, and fabric has a uniform texture.

Figure 1A:
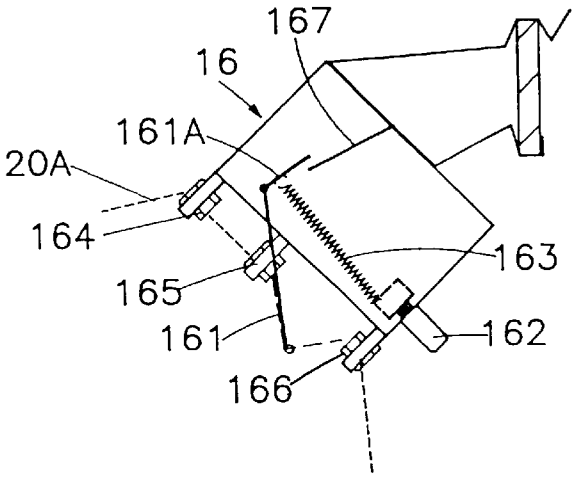
FIG. 1A is an enlarged view of a yarn tension detection arm shown in FIG. 1 showing the slackening of outgoing yarn by vibrating.

Referring to FIGS. 1 and 1A, there is shown the first preferred embodiment of yarn delivery apparatus according to the invention. Yarn 20 is derived from supply cone 11. Then yarn 20 is sent to simple yarn supply drum 30 through first lead-in yarn eye 12A, second lead-in yarn eye 12B, upper stop-motion device 14, and hook 15. Yarn 20 is tightened after being guided tangentially on yarn supply drum 30. As a result, the original wound yarn 20 in supply cone 11 is totally tightened and then adjusts the cam position provided on each knitting machine 40 (not shown) associated with the yarn tension detection arm 161 (FIG. 1A) such that yarn 20A may enter into knitting machine 40 for knitting under the same vibration of yarn tension detection arm 161 via a yarn guiding plate 31 having a lead-in yarn eye 311 and a lead-out yarn eye 315. With this, yarn sections are the same in length, loops are identical, and fabric has a uniform texture.

It is understood that yarn tension detection arm 161 may be implemented in many different devices such as a middle stop-motion device 16 shown in FIG. 1A. Note that the stop-motion device, lead-in yarn eyes 164–166, contact 161A, ground contact 167, spring 163, and adjustment knob 162 are prior art means such that a detailed description thereof is omitted herein for the sake of brevity.

Figure 4:
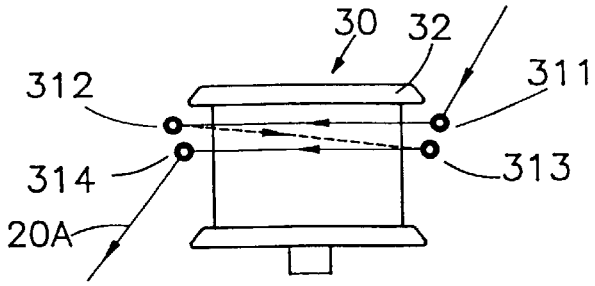
FIG. 4 is a side view of a simple yarn supply drum of a preferred embodiment according to the invention.

To tighten yarn 20 prior to entering yarn supply drum 30, a simple technique is to wind yarn 20 on yarn supply drum 30 an additional winding. Referring to FIG. 4, a simple yarn supply drum 30 has at least four lead-in yarn eyes 311–314. Yarn is led by lead-in yarn eye 311 to enter yarn supply drum 30 to wind thereon by a half winding. Then yarn passes through lead-in yarn eye 312 to move downward through lead-in yarn eye 313. Then yarn winds on yarn supply drum 312 by a half winding after leaving lead-in yarn eye 313. Finally, yarn passes through lead-in yarn eye 314. Above winding technique is implemented by the invention so as to achieve the tightening of yarn prior to entering knitting machine.

Accordingly, yarn 20A has a suitable tension after leaving yarn supply drum 30. Such tension can be further adjusted by a corresponding cam position so as to enter into knitting machine 40 for knitting under the same vibration of yarn tension detection arm 161. At this time, a spring of yarn tension detection arm 161 is preferably adjusted to a slackened position, i.e., not in contact with ground contact 167 as shown in FIG. 1A. With this, a uniform yarn with suitable tension is sent to knitting machine 40 to knit. It is also seen that since yarn 20A is uniform, it has a suitable tension such that yarn will cause a low wear-out to knitting machine 40 due to low friction force generated therebetween. With this, a plurality of advantages can be obtained, such as identical vibration of all yarn tension detection arms, the same length of yarn sections, and fine fabric.

It is understood that simple yarn supply drum 30 does not have the capability of storing yarn such that it is not applicable to high speed knitting. To overcome such a drawback, the invention adopts a bent path composed of a multiple-section arrangement technique prior to sending yarn to yarn supply drum 30. In detail, yarn length from supply cone 11 to yarn supply drum 30 (i.e., in the section of lead-in yarn eyes 12A and 12B, upper stop-motion device 14, and hook 15) is made much longer than the maximum length of yarn stored on yarn supply drum 30. Further, an upper stop-motion device 14 and a middle stop-motion device 16 are provided in the yarn feeding path. As a result, the yarn supplying process is stopped immediately after the tension of yarn disappears due to the grounding of contact 161A of the yarn tension detection arm 161 to the ground contact 167. With this, a breakage of fabric is relatively small. Further, the quality of fabric is improved significantly.

Figure 2A:
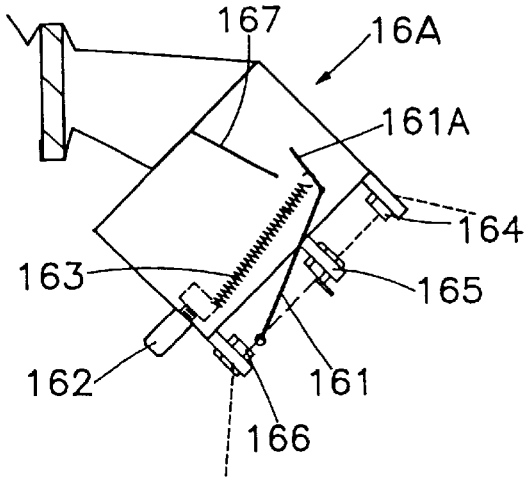
FIG. 2A is an enlarged view of a yarn tension detection arm shown in FIG. 2 showing the tightening of incoming yarn by vibrating.
Figure 2:
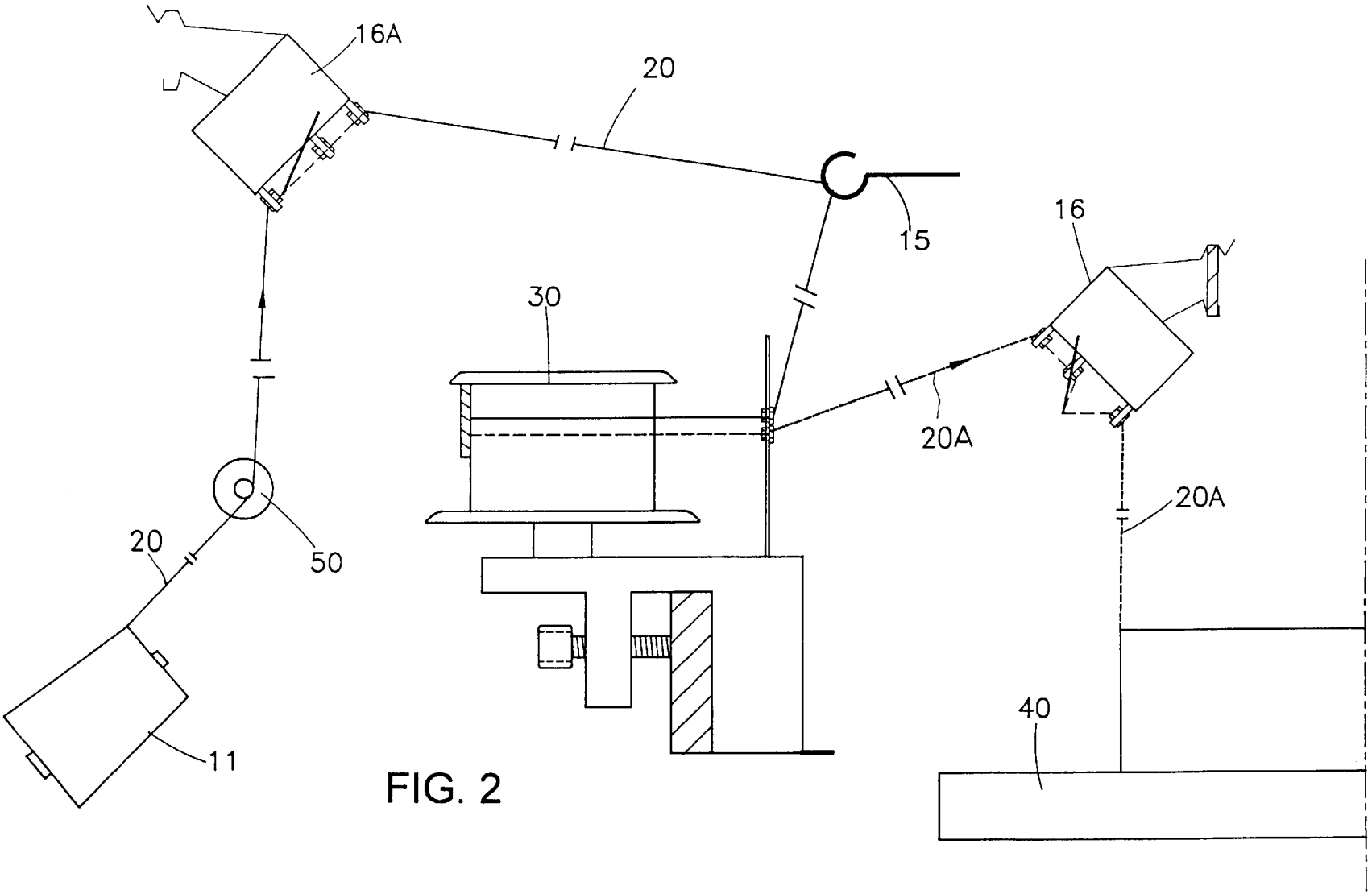
FIG. 2 is a side view of a second preferred embodiment of yarn delivery apparatus according to the invention.

FIGS. 2 and 2A shows a second preferred embodiment of yarn delivery apparatus according to the invention wherein upper stop-motion device 14 is replaced with middle stop-motion device 16A and a yarn brake means 50 is provided between supply cone 11 and middle stop-motion device 16A. Note that the number of yarn brake means 50 may be increased or even omitted. Moreover, yarn enters yarn supply drum 30 via a hook 15. These are differences between the first and second embodiments. In the second embodiment, the taut yarn before leaving yarn supply drum 30 is further extended to yarn brake means 50 in the front of supply cone 11. This technique arrangement as implemented by the second embodiment has a better effect than that of the first embodiment. In view of this, the tautness of yarn before entering knitting machine 40 is key to the texture of fabric.

Figure 3:
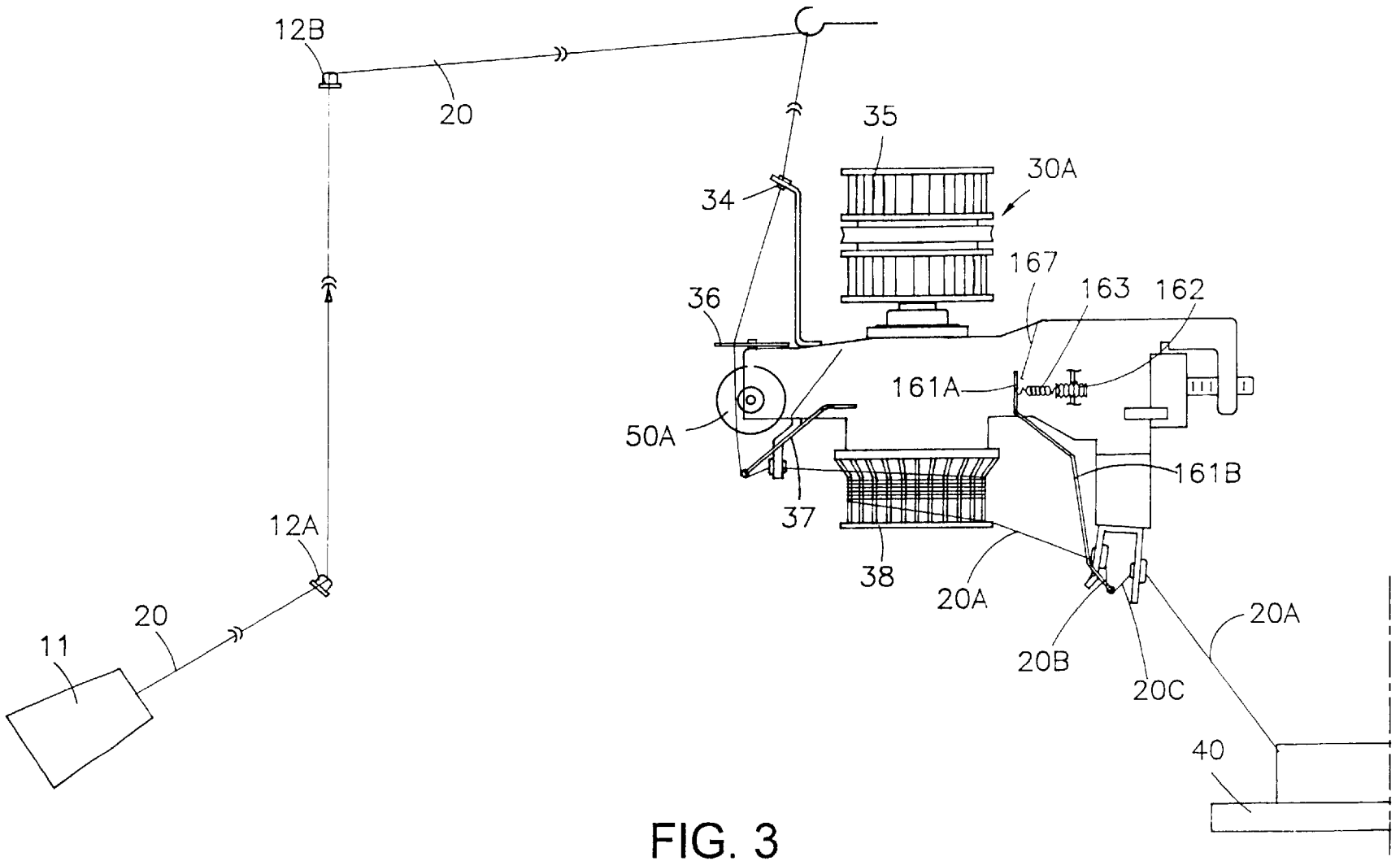
FIG. 3 is a side view of a third preferred embodiment of yarn delivery apparatus according to the invention in part axial section.

FIG. 3 shows a third preferred embodiment of yarn delivery apparatus according to the invention. The difference between this embodiment and the above two embodiments is detailed below. Simple yarn supply drum 30 is replaced with yarn storing drum 30A. Conventional weight-based yarn tension detection arm 161 is replaced with adjustment knob 162 and spring 163 of yarn tension detection arm 161B. Also, contact 161A of yarn tension detection arm 161B locates near ground contact 167 such that yarn tension detection arm 161B is very sensitive to the disappearance of yarn tension. Moreover, contact 161 A of yarn tension detection arm 161 is not in contact with ground. As shown, yarn brake means 50A and yarn tension detection arm 161B are provided on storing drum 30A. This is different from above embodiments in which yarn brake means 50 and yarn tension detection arm 161 are provided on yarn path. However, all achieve the same effect. As shown, yarn tension detection arm 161 B suitably slackens yarn by vibrating such that yarn may not enter into knitting machine 40 in a nonlinear low tension manner (e.g., V-shaped). Likewise, the height of the cam provided in the yarn feeding path is adjusted so as to cause yarn to enter into knitting machine 40 under the same vibration of yarn tension detection arm 161. Note that pulley 35 of storing drum, lead-in yarn arm 34, filter 36, incoming yarn detection arm 37, and storing drum 38 are prior art means such that a detailed description thereof is omitted herein for the sake of brevity.

It is seen that the yarn delivery apparatus according to the invention comprises a supply cone 11, a yarn brake means 50 (or lead-in yarn eyes 12A and 12B), upper stop-motion device 14 (or middle stop-motion device 16), yarn supply drum 30 (or storing drum 30A), and an adjustable yarn tension detection arm 161. Preferably, yarn is wound on the drum at least one winding if a simple storing drum is employed so as to tighten yarn before leaving yarn supply drum 30. Further, the yarn tension detection arm 161 is adjusted to its most slackened position so as to effectively sense the status of yarn. As such, identical vibration of all slackened yarn tension detection arms 161 may be obtained by adjusting the height of cam. With this, yarns may uniformly enter into knitting machine.

In brief, the yarn supplying method of the invention is implemented in two stages. That is, a first stage is implemented between the supply cone and the yarn that is leaving the yarn supply drum 30, and a second stage is implemented between the yarn that has left the yarn supply drum and knitting machine 40. Yarns are taut in the first stage, while yarns are suitably slackened with optimum tension in the second stage. Further, cam position is adjusted so as to cause all yarns to have the same tension before entering the knitting machine 40 for knitting. With this, the yield is maximized, the loop length per delivery is maximized, loops are uniform and identical, and fabric has the advantages of smoothness, high elasticity, and low contraction.

While the invention herein disclosed has been described by means of specific embodiments, numerous modifications and variations could be made thereto by those skilled in the art without departing from the scope and spirit of the invention set forth in the claims.

What is claimed is:

1. A uniform yarn delivery method for a knitting machine having a yarn supply cone, a yarn supply drum and a cam position, said method comprising the steps of:

(1) sending yarn derived from the yarn supply cone to be guided tangentially on the yarn supply drum so as to tighten the yarn thereon;

(2) uniformly slackening the taut yarn sent from the yarn supply drum prior to sending to a yarn tension detection arm;

(3) the yarn tension detection arm elastically vibrating the yarn; and (4) adjusting the cam position relative to the yarn tension detection arm so as to cause the yarn to enter into the knitting machine under the same vibration of the yarn tension detection arm such that the yarn forms sections with the same length and identical loops in order to achieve a uniform knitted fabric.

2. The uniform yarn delivery method of claim 1, wherein the yarn sent from the yarn supply drum is guided by a bent feeding path composed of multiple-sections prior to entering into the knitting machine.

3. The uniform yarn delivery method of claim 1, wherein the yarn sent from the yarn supply drum is wound on the yarn supply drum at least one winding so as to tighten the yarn.

4. The uniform yarn delivery method of claim 1, wherein the yarn is guided by a bent feeding path composed of multiple-sections prior to entering into the yarn supply drum so as to increase the length of the yarn section between the yarn supply cone and the yarn supply drum.

5. A uniform yarn delivery method for a knitting machine having a yarn supply cone, a yarn supply drum and a cam position, said method comprising the steps of:

(1) tightening yarn derived from the yarn supply cone prior to sending to the yarn supply drum for being guided tangentially thereon;

(2) uniformly slackening the taut yarn sent from the yarn supply drum prior to sending to a yarn tension detection arm;

(3) the yarn tension detection arm elastically vibrating the yarn; and (4) adjusting the cam position relative to the yarn tension detection arm so as to cause the yarn to enter into the knitting machine under the same vibration of the yarn tension detection arm such that the yarn forms sections with the same length and identical loops formed to achieve a uniform texture fabric.

6. The uniform yarn delivery method of claim 2, wherein the yarn sent from the yarn supply drum is guided by a bent feeding path composed of multiple-sections prior to entering into the knitting machine.

7. The uniform yarn delivery method of claim 2, wherein the yarn is guided by a bent feeding path composed of multiple-sections prior to entering into the yarn supply drum so as to increase the length of the yarn section between the yarn supply cone and the yarn supply drum.

8. A uniform yarn delivery apparatus for a knitting machine having a yarn supply cone to supply the yarn and a cam, said apparatus comprising:

a yarn supply drum;

an outgoing yarn tension detection arm associated with the yarn supply drum;

a lead-in yarn eye located between the yarn supply drum and the supply cone for guiding the yarn;

a stop-motion device having a yarn brake with a spring located between the supply drum and the supply cone; and a hook located near the outgoing yarn tension detection arm;

wherein at least one winding of yarn is stored on the circumference of the yarn supply drum, and the spring of the yarn brake of the stop-motion device adjusts the vibration of the yarn so as to perform in cooperation with the cam position to adjust the vibration of the outgoing yarn tension detection arm, thereby preliminarily tightening the yarn prior to sending the yarn from the supply cone to the yarn supply drum, and the yarn tension detection arm elastically vibrates the yarn so as to cause the yarn to be uniformly slackened with an optimum tension before entering the knitting machine.

9. The uniform yarn delivery apparatus of claim 8, wherein the yarn supplying is stopped immediately after the tension of the yarn disappears due to the outgoing yarn tension detection arm near to a ground contact.

10. A uniform yarn delivery apparatus for a knitting machine comprising:

a storing drum;

an outgoing and incoming yarn tension detection arm associated with the storing drum;

a cam;

a yarn stop-motion device having a spring;

a yarn brake means; and a plurality of yarn guiding means for guiding the yarn derived from a supply cone to the yarn tension detection arm;

wherein the spring of the yarn stop-motion device in the outgoing yarn path of the storing drum adjusts the vibration of the yarn so as to perform in cooperation with the cam position to adjust the vibration of the outgoing yarn tension detection arm, thereby preliminarily tightening the yarn prior to leaving the storing drum, the yarn is uniformly slackened to cause it to have an optimum tension, and adjusts the cam position so as to cause all yarn to have the same tension before entering the knitting machine such that yarn sections with the same length, identical loops formed by the yarns, and a uniform texture fabric are effected.

11. The uniform yarn delivery apparatus of claim 10, wherein the yarn supplying is stopped immediately after the tension of the yarn disappears due to the outgoing yarn tension detection arm near to a ground contact.

12. The apparatus of claim 10, wherein the yarn forms sections with the same length and identical loops and a uniform texture fabric.

* * * * *

UNITED STATES PATENT AND TRADEMARK OFFICE

CERTIFICATE OF CORRECTION

PATENT NO. : 6,202,450 B1
DATED : March 20, 2001
INVENTOR(S) : Chen

It is certified that error appears in the above-identified patent and that said Letters Patent is hereby corrected as shown below:

Drawings:
[Sheet 2 of 4] Fig. 2A, "16A" should be -- 16 --.

Column 3,
Line 61, "16" should be -- 16A --.

Signed and Sealed this

Twenty-fifth Day of September, 2001

*Attest:*

Nicholas P. Godici

NICHOLAS P. GODICI
*Acting Director of the United States Patent and Trademark Office*

*Attesting Officer*